United States Patent [19]

Alota et al.

[11] Patent Number: 4,875,983

[45] Date of Patent: Oct. 24, 1989

[54] PROCESS FOR CONTINUOUS ELECTRODEPOSITION OF CHROMIUM METAL AND CHROMIUM OXIDE ON METAL SURFACES

[75] Inventors: Santa Alota; Vincenzo Ferrari; Massimo Memmi; Leonardo Pacelli; Susanna Ramundo, all of Rome, Italy

[73] Assignee: Centro Sviluppo Materiali SpA, Rome, Italy

[21] Appl. No.: 195,958

[22] Filed: May 17, 1988

[30] Foreign Application Priority Data

May 13, 1987 [IT] Italy ..... 47918 A/87

[51] Int. Cl.[4] ..... C25D 3/06; C25D 7/06

[52] U.S. Cl. ..... 204/28; 204/51; 204/56.1; 204/DIG. 8; 204/DIG. 9

[58] Field of Search ..... 204/28, 51, 97, DIG. 8–9, 204/56.1

[56] References Cited

U.S. PATENT DOCUMENTS

| | | | |
|---|---|---|---|
| 4,167,460 | 9/1979 | Tomaszewski | 204/51 |
| 4,495,008 | 1/1985 | Bruno et al. | 148/31.5 |
| 4,511,633 | 4/1985 | Bruno et al. | 428/666 |
| 4,547,268 | 10/1985 | Bruno et al. | 204/28 |

FOREIGN PATENT DOCUMENTS 2586711 3/1987 France .

*Primary Examiner*—John F. Niebling
*Assistant Examiner*—David Ryser
*Attorney, Agent, or Firm*—Young & Thompson

[57] ABSTRACT

In the continuous electrodeposition of chromium metal and chromium oxide on metal surfaces the codeposition of chromium and its oxide, inert and insoluble, is obtained from the same bath and at high current density, by using a number of cycles of impressed cathodic current and defined ranges of electrolyte velocities in the deposition cell. In this manner a product is obtained wherein a specific quantitative relationship between chromium metal and chromium oxide ensures corrosion resistance superior to that obtainable in known products.

9 Claims, No Drawings

PROCESS FOR CONTINUOUS ELECTRODEPOSITION OF CHROMIUM METAL AND CHROMIUM OXIDE ON METAL SURFACES

DESCRIPTION

The present invention relates to a process for continuous electrodeposition of chromium metal and chromium oxide on metal surfaces. More precisely it relates to the electrocodeposition of chromium metal (hereinafter referred to as chromium of Cr) and a mixture of oxides and hydroxides mainly of trivalent chromium (hereinafter referred to as chromium oxide of $CrO_x$), intimately mixed in a very thin layer and anyway with extremely good covering power and protective properties. This codeposition occurs on bases consisting of continuous bodies of steel coated with zinc or zinc alloys (e.g. Zn-Al, Zn-Fe, Zn-Ni, etc.), hereinafter referred to as zinc or galvanized.

As known, steel requires protection against corrosion for most applications; this can be assured, for instance, by coating it with other metals. In this respect zinc is of particular interest because it is electrochemically sacrificial vis-à-vis iron. This means that if for any reason (e.g. a scratch, a cut, etc.) a limited area of the substrate of a galvanized steel product is exposed, the surrounding zinc corrodes, thus protecting the uncovered zone.

In coated products the life of the protection depends, of course, on the completeness and life of the coating which, in turn, depends on the thickness of the coating. Many practical requirements often call for product life in excess of that guaranteed by technically and economically feasible zinc coatings. It is necessary, therefore, to provide better protection—and hence a longer life—for products without unduly increasing the cost and thickness of coatings.

Work has been done and advances have been made along these general lines. In particular, attention is drawn to the work performed by the inventors themselves, because of the good results obtained and the fact that these have been translated into the first sizeable industrial application. The work, which has introduced big improvements in $Cr+CrO_x$ coatings, is described, for instance in U.S. Pat. Nos. 4,511,633 and 4,547,268.

The advisability of having a coating of chromium and chromium oxide, stems from the fact that with thin coatings of chromium metal the coating is not continuous and is extremely porous, leaving the substrate uncovered. The chromium oxide serves to seal these discontinuities and the porosity, thus ensuring continuous protection for the substrate.

Despite the progress made to date, the drawback of such coatings on zinc-based substrates is the relative slowness of the production processes which often call for two treatment baths and anyway for relatively low current densities (typically less than 50A/dm$^2$), especially for the deposition of chromium oxide. This means that the plants have to be slow, which is not in accord with the new high-current-density galvanizing techniques and high-speed treatment lines. It is impossible, therefore, to conduct the galvanizing and $Cr+CrO_x$ deposition processes in one continuous sequence at high production speeds.

What is needed is to alter the general electrodeposition conditions, by increasing the treatment rate and hence the current density, while operating, if possible, in a single bath.

At the present time the only example of high-current-density chromium and chromium oxide deposition is that for the production of chromium-type tin-free steel which is a product designed to replace tinplate, the tin being replaced by a thin layer of chromium metal and chromium oxide. Modern production processes for this material utilize high line speeds and high current densities (typically 400–500 m/min and 250–350 A/dm$^2$) to obtain a coating consisting of 50–150 mg/dm$^2$ of chromium and from 6 to 15 mg/m$^2$ of chromium oxide (as $Cr_2O_3$) (the data refer to products currently being marketed). In the coating, however, the ratio of Cr metal to oxide is virtually constant at around 10–12% $Cr_2O_3$.

It might readily be thought on the basis of these technical data that the teaching derived from the production of tin-free steel could provide an excellent starting point for the transfer of this technology to galvanized products. In actual fact, however, things are much more complicated for several reasons, the most important of which are as follows:

It has been found that the formation of a trivalent chromium oxide deposit, which is highly insoluble, together with the deposition of chromium metal, occurs at a potential that results in the discharge of hydrogen ions (see "Electrochemical Technology", Vol. 6, n° 11–12 (1968), 389–393). It is thought that the discharge of these ions favors the precipitation of chromium oxide by causing local alkalinization. The discharge of hydrogen ions is thus essential for the process; the greater the discharge current the greater local alkalinization and the more abundant the precipitation of chromium oxide.

In the case of tin-free steel, the hydrogen discharge current, which is the measure of the facility and magnitude of the discharge, is about $10^{-6}$A/cm$^2$, both for the reaction on the iron and for that on the chromium; this means that the reaction is of more or less the same magnitude on the substrate as on the coating, favoring the formation of a uniform, continuous layer of chromium oxide.

However, notwithstanding these favorable conditions, the quantity of trivalent chromium oxide produced in tin-free steel is relatively low, amounting to around 8 or 12% of the total coating.

In the case of galvanized products, the discharge of hydrogen ions on the zinc occurs with a current of about $10^{-11}$A/cm$^2$(see "Encyclopedia of Electrochemistry of the Elements" ed. A. J. Bard; M. Dekker Inc; vol. IX, Part A, Page 456). This means that the discharge of hydrogen ions on the zinc should occur at an intensity that is too low to cause enough local alkalinization to produce significant amounts of chromium oxide, the deposition of which is thus sparse and discontinuous.

In the further coating of galvanized strip it is necessary to have a deposit of chromium and chromium oxide that is quite rich in this latter material. However, while the abundant patent documentation on this subject indicates that relatively low current densities (10–50 A/dm$^2$) are required for the satisfactory, controllable deposition of chromium oxide on zinc, there is the fact that in "Modern Electroplating, Page 92 (1974 Edition produced by F. A. Lowenheim for the Electrochemical Society) it is stated that if the chromium deposit is too passive, namely if it contains a large quantity of chromium oxide, it tends to occur as nonadherent layers that readily separate from one another, especially when there are current interruptions, in which case the deposited film tends to redissolve quite rapidly. This latter detail is confirmed also by the small quantities of chromium produced in the tin-free steel process where, for eminently practical reasons, the anodes consist of conducting sections separated by nonconducting zones.

There are no reliable theories regarding the electrolytic deposition of chromium and chromium oxide from chromic acid baths (see "Modern Electroplating", op. cit., G. Dubpernell's chapter on chronium).

Similar concepts were put forward more recently in the paper presented by M. McCornick et al., of the University of Sheffield, at the Cleveland Symposium on ElectroPlating Engineering and Waste Recycle, New Developments and Trends, August-September 1982.

This outline on the state of knowledge of chromium and chromium oxide electrodeposition shows quite clearly that available literature does not directly indicate or even suggest in any way how to obtain coatings of chromium metal and trivalent chromium oxide on zinc or zinc alloys, in one single high-current-density operation in which the ratio between the quantity of chromium metal and chromium oxide can be controlled to ensure high chromium oxide contents. It should be pointed out that here the phrase "one single high-current-density operation" means the precipitation of chromium oxide at the same time as the electrodeposition of chromium metal, it being understood that the process will most probably be performed in a series of separate electroplating cells.

The object of this invention is to permit the formation of a protective layer of metallic chromium mixed with trivalent chromium oxide by pulsed high-current-density electrochemical treatment. Another object of the invention is to permit formation of said layer in a bath with a single composition. Yet a further object is to permit continuous regulation of the chromium oxide content with a single high-current-density bath, even towards relatively high oxide percentages. Contrary to the conclusions that emerge so clearly from the above documentation on the state of the art according to the present invention it has surprisingly been found that a compact, adherent, very corrosion resistant deposit of chromium metal and trivalent chromium oxide can be obtained from chromic acid solutions with current densities up to at least 600 A/dm$^2$, by impressing a certain number of current pulses on the strip, while keeping the electrolyte velocity above minimum specific values.

According to the present invention a process is proposed in which a continuous metal body (e.g. strip, wire, wirerod or the like) preferably with an inorganic coating of zinc or alloys of zinc with other metals, is continuously immersed in an electrolyte that is strongly acid due to the presence of chromic acid contained in at least one electrolytic cell in which said metal body acts as cathode, said process being characterized in that said metal body is subjected to pulsating electrolytic cathodic treatment, comprising at least three successive pulses of current with a density of at least 50 A/dm$^2$, while it is immersed in said electrolyte whose pH is less than 3 and whose velocity is over 0.5 m/s, so as to ensure a renewal of the electrolyte on the surface of the body to be treated, sufficient to permit the correct development of the electrochemical reactions as a function of the impressed current density. The current density is preferably in excess of 80 A/dm$^2$, while the velocity of the electrolyte is between 1 and 5 m/s.

At the present state of the art, an economic embodiment in line with other achievements in the field of electrogalvanizing, for instance, provides for a current density between 100 and 200 A/dm$^2$ with an electrolyte velocity between 1 and 2.5 m/s.

The minimum number of pulses received by said continuous metal body during treatment is three, because with fewer it is difficult to obtain the desired quality at high current densities. As regards the maximum number of pulses, at the present state of knowledge it can be said that the limit is dictated by economic rather than technical and scientific considerations. In laboratory experiments twenty-four pulses have been applied without any evident decline in quality, while in pilot plant trials the maximum number used was eight, in relation essentially to the modular structure of the anodes and the number of cells available (two cells each with two anodes divided into two). However, at the moment there is no evidence—other than that of a technico-economic nature—which might advise limiting the maximum number of pulses to a given level. The duration of each pulse, and also the time between two pulses (with the strip always in the electrolyte) is in the 0.05 to 4 second range in each case; however, the waveform of the pulse does not need to be symmetrical, in other words the time between two pulses can be different from the duration of each pulse. It has also been noted, especially when the time between two successive pulses is greater than two seconds, that on the pulsed current a base or carrier current can be superimposed, which, if used, can be up to 30 A/dm$^2$; its primary purpose is to stabilize the chromium oxide content of the coating.

The composition of the electrolytic bath for embodiment of this invention is preferably selected from within the following ranges:

$CrO_3$: 20–80 g/l; and, as optional components, $H_2SO_4$ from 0 to 1.0 g/l trivalent chromium salts from 0 to 5 g/l (as $Cr^{+3}$); 40% $HBF_4$ from 0 to 5 ml/l; NaF from 0 to 2 g/l; $Na_2SiF_6$ from 0 to 2 g/l. At least two of the optional components must be present, with a total concentration of at least 1.5 g/l. The pH of the resulting bath is between 0 and 3, preferably between 0.5 and 1.5. Treatment temperature is preferably between 40° and 60° C.

By following the process described above, not only is a uniform deposit of chromium metal and trivalent chromium oxide obtained surprisingly at high current density on zinc or its alloys with other metals, but also even more surprisingly there is a big increase in the corrosion resistance of the products thus obtained.

In this regard the effect of the morphology of the zinc substrate on the quality of the overlying layer of chromium and chromium oxide is extremely interesting. It has been found, in fact, that by treating as per this invention a galvanized material produced according to Italian Patent Application 48371 A85, in which the zinc is in the form of mono-oriented microcrystals, a product is obtained whose red-rust resistance (ASTM B117) is considerably better than that of similar products in which the zinc deposit, however, is normally poly-oriented.

It is not as yet clear why such compact, adherent deposits of chromium and chromium oxide are obtained, nor why there is the increase in corrosion resistance just referred to. However, thorough examinations by X-Ray Photoelectric Spectroscopy (XPS) of the surfaces of the products obtained as per the present invention and of products already known, such as tin-free steel, reveal that in tin-free steel and in products that have been galvanized and then coated with chromium and chromium oxide according to known techniques, the quantity of $CrO_x$—if deposited at the same time as the metallic chromium—is more or less constant and in relation to the quantity of metallic chromium deposited (10–12% by wt. effective chromium oxide for tin-free steel, and 10–15% for products obtained as per published methods), while in the case of products obtained according to the present invention it is possible to ensure much larger quantities (by weight) of chromium oxide. XPS analysis has revealed atomic percentages of chromium (from chromium oxide) ranging between 15 and 30% or so of the total chromium deposited. As the degree of hydration of chromium oxide cannot be established precisely, it is impossible to indicate the exact quantity of chromium oxide deposited. However, because of the very insoluble nature of that oxide, the error made by assuming a near zero final hydration should not be great; in that case, the amount of precipitated chromium oxide should range from about 21% to about 38% by weight of the total deposit.

It has been established by XPS examination that the greater part of the chromium oxide in tin-free steel occurs on the surface of the coating; indeed, at a depth of 80 Angstroms the chromium present is virtually all metallic chromium. In the products as per this invention, instead, the chromium oxide is distributed more evenly throughout the thickness of the coating, being found at more or less the same concentration both on the surface of the coating and at the boundary with the zinc, some 2000 to 3000 Angstrom below the surface.

Before explaining the invention by means of examples, it will be useful to comment briefly on the limits imposed on the ranges of variability of the pertinent parameters.

Where current density is concerned, the limit of 50 $A/dm^2$ derives from the fact that, at least for the deposition of chromium oxide, this value represents the lower limit of high density; 60 $A/dm^2$ is the maximum value the inventors have tried. However, the experimental work has not revealed any particular reasons to believe that even higher current densities would not be practicable. The maximum limit imposed is thus dictated by economic considerations which—if appropriately overcome—could usefully permit treatment at even higher current densities.

The velocity of electrolyte flow is a very important factor: only by exceeding certain velocities, and thus certain levels of turbulence in the electrolyte, is it possible to operate at high current densities. In this perspective, velocities of less than 0.5 m/s would barely permit the required constancy of results to be attained, while velocities in excess of 5 m/s are virtually useless.

In the following examples, an analysis is made of various tests to ascertain the corrosion resistance of a product for which it is expected there should be a rapidly growing market, namely one-side galvanized steel strip for car building, coated on the galvanized side with chromium and chromium oxide. For the sake of comparison, various galvanized steels have been selected, namely, low-current-density (20–30 $A/dm^2$) commercial galvanized strip, high-current-density (100–150 $A/dm^2$) mono-oriented galvanized strip, as per Italian Patent Application 48371 A85, and low-current-density commercial strip coated with chromium and chromium oxide. As will be seen, the tests performed do not include the one according to ASTM B117 for resistance to the appearance of rust in the salt-spray cabinet (S.S.C.) because it is too aggressive and often cannot distinguish between significantly different situations. Furthermore the SSC employs corrosion mechanisms that are too far removed from reality to provide a correct means of control.

Specific corrosion cycles more suitable for simulating the real situation have thus been selected. These will be described hereinafter.

One-side galvanized strip with a 7 μm coating of zinc has been utilized for all the tests. The weight of the chromium and chromium oxide coating in all cases was between 0.8 and 1 $g/m^2$ of total chromium.

For treatment as per the invention, in particular, use has been made of high-current-density galvanized steel strip with a mono-oriented microcrystalline zinc coating, treatment at various current densities and a variable number of pulses in a solution including: $CrO_3$ 35 g/l; 40% $HBF_4$ 0.5 ml; NaF 1 g/l; pH 1.5; bath temperature 50° C.

The invention will now be explained, purely for the purpose of exemplification and in no way limiting the objects and scope of the invention, by reference to the following examples concerning several production techniques, the products obtained and the corrosion resistance thereof.

EXAMPLE 1

Resistance to perforating corrosion Using the above-described bath, numerous samples were prepared adopting different electrolyte velocities and current densities, as indicated in Table 1. The quantities of total chromium and the percentages of $Cr^{+3}$ on total chromium, in % atoms, are the averages of at least four XPS analyses. The times reported (Δh rusting) represent the increase in hours for the appearance of rust, compared with a normal low-current-density commercial galvanized strip, taken as reference. The appearance-of-rust value is significant also for perforating corrosion, since rusting signals that protection afforded by the zinc has ceased and that hence the appearance of the hole depends solely on the thickness of the steel.

TABLE 1

| Current density $A/dm^2$ | Deposit characteristics | Number of pulses | | | | | | | | | | | | | | |
|---|---|---|---|---|---|---|---|---|---|---|---|---|---|---|---|---|
| | | 2 | | | 4 | | | 8 | | | 16 | | | 24 | | |
| | | Electrolyte velocity m/s | | | | | | | | | | | | | | |
| | | 0.2 | 0.6 | 1.0 | 0.5 | 1.0 | 1.5 | 1.0 | 1.5 | 2.5 | 1.0 | 1.5 | 2.5 | 1.5 | 2.5 | 3.5 |
| | Cr. tot. $g/m^2$ | 0.81 | 0.78 | 0.87 | 0.92 | 0.87 | 0.82 | 0.98 | 0.97 | 0.98 | 0.93 | 0.94 | 0.94 | — | — | — |
| 80 | $Cr^{+3}$ atom | 9 | 9 | 12 | 16 | 18 | 16 | 19 | 22 | 20 | 16 | 20 | 20 | — | — | — |
| | Δh rusting | 104 | 100 | 115 | 330 | 385 | 310 | 390 | 581 | 586 | 400 | 560 | 558 | — | — | — |
| | Cr tot. $g/m^2$ | 0.90 | 0.87 | 1.06 | 0.96 | 0.86 | 0.88 | 0.91 | 0.90 | 0.89 | 0.90 | 0.91 | 0.90 | — | — | — |
| 150 | $Cr^{+3}$ % atom | 6 | 6 | 8 | 14 | 23 | 22 | 22 | 26 | 26 | 24 | 26 | 25 | — | — | — |
| | Δh rusting | 100 | 100 | 106 | 189 | 430 | 420 | 420 | 665 | 660 | 590 | 670 | 676 | — | — | — |
| | Cr tot. $g/m^2$ | 0.80 | 0.92 | 0.91 | 0.98 | 0.94 | 0.94 | 0.89 | 0.93 | 1.01 | 0.87 | 0.85 | 0.92 | — | — | — |
| 300 | $Cr^{+3}$ % atom | 6 | 6 | 8 | 12 | 18 | 18 | 18 | 26 | 22 | 20 | 28 | 23 | — | — | — |
| | Δh rusting | 90 | 93 | 100 | 180 | 357 | 360 | 660 | 751 | 748 | 788 | 845 | 853 | — | — | — |
| | Cr tot. $g/m^2$ | — | — | — | — | — | — | — | — | — | 0.92 | 0.91 | 0.89 | 0.93 | 0.94 | 1.10 |

TABLE 1-continued

| Current density A/dm² | Deposit characteristics | Number of pulses 2 | | | 4 | | | 8 | | | 16 | | | 24 | | |
|---|---|---|---|---|---|---|---|---|---|---|---|---|---|---|---|---|
| | | Electrolyte velocity m/s | | | | | | | | | | | | | | |
| | | 0.2 | 0.6 | 1.0 | 0.5 | 1.0 | 1.5 | 1.0 | 1.5 | 2.5 | 1.0 | 1.5 | 2.5 | 1.5 | 2.5 | 3.5 |
| 450 | $Cr^{+3}$ % atom. | — | — | — | — | — | — | — | — | — | 21 | 26 | 26 | 26 | 30 | 30 |
| | Δh rusting | — | — | — | — | — | — | — | — | — | 786 | 890 | 860 | 887 | 980 | 1032 |
| | Cr tot. g/m² | — | — | — | — | — | — | — | — | — | 0.87 | 0.88 | 0.86 | 0.98 | 0.95 | 1.03 |
| 600 | $Cr^{+3}$ % atom. | — | — | — | — | — | — | — | — | — | 24 | 23 | 26 | 28 | 29 | 31 |
| | Δh rusting | — | — | — | — | — | — | — | — | — | 580 | 610 | 690 | 940 | 1020 | 1080 |

To facilitate understanding of the Table it should be noted that the increased corrosion resistance of a mono-oriented galvanized product made as per the aforesaid Italian Patent Application No. 48371 A85 is about 90 hours, while the increased perforation resistance of a low-current-density commercial galvanized product coated with chromium and chromium oxide as per U.S. Pat. No. 4,547,268 is 183 hours.

Specimens obtained as per the process covered by U.S. Pat. No. 3,816,082 have an average resistance to perforating corrosion of 169 hours.

The laboratory test employed provides for the continuous repetition of the following cycle until the appearance of rust:

15 minutes in 5% NaCl solution 75 minutes drying at room temperature 22.5 hours in a constant humidity cabinet at 95–100% relative humidity at 40° C.

EXAMPLE 2

Resistance to cosmetic corrosion, I To check the effect of the deposit of chromium metal and trivalent chromium oxide on the resistance to cosmetic corrosion under low oxygen conditions (e.g. mixed joint) a paint peeling test was run using the cathodic disbonding technique. The test is designed to reproduce rapidly the effect of alkalinization at the paint/metal substrate interface; it consists in applying a cathodic current of −b 30 μA/cm² for 24 hours to specimens painted with the cataphoretic automobile cycle (15 μm of paint) having a 500 mm² circular area etched with a 2×2 mm grid so as to uncover the zinc, the specimens being immersed in 0.5M NaCl. At the end of the test period the specimens are washed in distilled water, dried and subjected to the tape strip test. The areas thus treated are then examined by Quantitative Television Microscopy (QTM) to measure the extent of paint peeling (disbonded area).

The following results are the averages of at least ten different observations:

Coating as per invention, 300 A/dm², 8 pulses
Electrolyte velocity: 1.0 m/s Disbonded area: 34 mm²
Electrolyte velocity: 1.5 m/s Disbonded area: 23 mm²
Electrolyte velocity: 2.5 m/s Disbonded area: 22 mm²
Bare steel Disbonded area: 58 mm²

-continued

Double layer Zn—Fe coating Disbonded area: 68 mm²
Zn—Ni 12% coating Disbonded area: 75 mm²
Electrogalvanized Disbonded area: 267 mm²

EXAMPLE 3

Resistance to cosmetic corrosion, II The test employed in the previous example is capable of revealing macroscopic differences in behavior between different products, and it is very useful. However, it cannot reveal more subtle but nevertheless important differences in behavior. Therefore another more sensitive test which is easier to control in the laboratory has also been used. This provides a measurement of the chemical stability of the metal/ paint interface, and hence permits an assessment of cosmetic corrosion resistance.

As indicated in the J.Electroanal.Chem.,118(1981), 259–273, the behavior of an electrochemical reaction, and thus that of the electrochemical cells it represents, can be interpreted by means of an equivalent electrical circuit whose physical components represent the electrochemical processes that occur in the cell. The electrode impedance method examined in the article in question enables an estimate to be made of the type and mathematical value of each circuit component.

As explained in SAE Report 862028 (Automotive Corrosion and Prevention Conference, Dearborn, Mich., Dec. 8–10, 1986), with regard to FIG. 1*a*, the corrosion current, $i_{corr}$ is related to polarization resistance Rp by the formula:

$$i_{corr} = B\ Rp^{-1}$$

where B is a factor depending on the anodic and cathodic slopes of the Tafel networks and, in this particular case, is equal to 0.03 V.

The experimental measurements are made by applying to the cell potentiostatic sine-wave signals at various frequencies, from 1mHz to 10 KHz, and ascertaining how value Rp varies with time. In the case in point, the work was done with specimens painted as per the automobile cataphoretic cycle, with paint thickness of 15 μm, immersed in 0.5M NaCl solution. The results obtained are summarized in Table 2.

TABLE 2

| Time (days) | Rp (K Ω cm²) Low current density electrogalvanized 7 μm | High current density electrogalvanized mono-oriented, 7 μm + Cr and $CrO_x$ 150 A/dm², 4 pulses 1.0 m/s | 150 A/dm², 4 pulses 1.5 m/s | 150 A/dm², 8 pulses 1.0 m/s | 150 A/dm², 8 pulses 1.5 m/s | 300 A/dm², 8 pulses 1.5 m/s | 300 A/dm², 8 pulses 2.5 m/s |
|---|---|---|---|---|---|---|---|
| 1 | 150 | 500 | 500 | 600 | >900 | >900 | >900 |
| 4 | 50 | 400 | 400 | 500 | 600 | 950 | 900 |
| 12 | 50 | 200 | 250 | 300 | 400 | 700 | 750 |
| 28 | 50 | 150 | 200 | 200 | 300 | 400 | 450 |

TABLE 2-continued

| Time (days) | Rp (K Ω cm²) Low current density electro-galvanized 7 μm | High current density electrogalvanized mono-oriented, 7 μm + Cr and $CrO_x$ 150 A/dm², 4 pulses 1.0 m/s | 150 A/dm², 4 pulses 1.5 m/s | 150 A/dm², 8 pulses 1.0 m/s | 150 A/dm², 8 pulses 1.5 m/s | 300 A/dm², 8 pulses 1.5 m/s | 300 A/dm², 8 pulses 2.5 m/s |
|---|---|---|---|---|---|---|---|
| 40 | 50 | 100 | 100 | 150 | 300 | 300 | 350 |

What is claimed is:

1. Process for continuous electrodeposition of chromium metal and trivalent chromium oxide on metal surfaces, in which a continuous metal body is continuously immersed in an electrolyte, that is strongly acid due to the presence of chromic acid, contained in at least one electrolytic cell in which said metal body acts as cathode, characterized in that said metal body is subjected to an electrolytic cathodic treatment comprising at least three successive pulses of current with a density of at least 50 A/dm², while it is immersed in said electrolyte that has a pH of less than 3 and a velocity of over 0.5 m/s.

2. Electrodeposition process as in claim 1, characterized in that the current density is in excess of 80 A/dm², while the electrolyte velocity is between 1 and 5 m/s.

3. Electrodeposition process as in claim 2, characterized in that the current density is between 100 and 200 A/dm², with the electrolyte velocity between 1 and 2.5 m/s.

4. Electrodeposition process as in claim 1, characterized in that the number of current pulses is between 3 and 24.

5. Electrodeposition process as in claim 4, characterized in that the duration of each pulse, and also of the time between one pulse and the next, with the continuous metal body immersed in the electrolyte, is between 0.05 and 4 s.

6. Electrodeposition process as in claim 5, characterized in that, especially when the time between two successive pulses is in excess of 2 seconds, a carrier current with a density of up to 30 A/dm² is impreseed on the pulsed current.

7. Electrodeposition process as in claim 1, characterized in that said electrolyte comprises: $CrO_3$ 20 to 80 g/l and, as optional components, $H_2SO_4$ from 0 to 1.0 g/l;trivalent chromium salts between 0 and 5 g/l (as $Cr^{+3}$); 40% $HBF_4$ from 0 to 5 ml/l; NaF from 0 to 2 g/l; $Na_2SiF_6$from 0 to 2 g/l; and at least two of said optional components are present with a total concentration of at least 1.5 g/l.

8. Electrodeposition process as in claim 7, characterized in that the pH of the electrolyte is between 0 and 3 and the temperature between 40° and 60° C.

9. Electrodeposition process as in claim 8, characterized in that the pH of the electrolyte is between 0.5 and 1.5.

* * * * *